United States Patent [19]

Kielersreiter et al.

[11] 4,199,971

[45] Apr. 29, 1980

[54] METHOD FOR THE MANUFACTURE OF PROFILED REED BLADES FOR LOOM REEDS

[75] Inventors: Fritz Kielersreiter, Tann-Rüti, Switzerland; Hubertus H. Rouleaux, Venlo, Netherlands

[73] Assignees: Ruti Machinery Works Ltd., Ruti, Switzerland; Ruti-Te Strake B.V., Deurne, Netherlands

[21] Appl. No.: 845,131

[22] Filed: Oct. 25, 1977

[30] Foreign Application Priority Data

Oct. 28, 1976 [CH] Switzerland ..... 013583/76
Sep. 20, 1977 [CH] Switzerland ..... 011469/77

[51] Int. Cl.[2] ..... B21D 28/00

[52] U.S. Cl. ..... 72/336; 72/338; 113/116 V; 29/418

[58] Field of Search ..... 113/116 R, 116 F, 116 V, 113/116 Y; 72/334, 336, 338; 139/192, 435; 51/5 C

[56] References Cited

U.S. PATENT DOCUMENTS

| | | | |
|---|---|---|---|
| 1,675,913 | 7/1928 | Sibley | 113/116 V |
| 3,566,660 | 3/1971 | Dedek | 72/339 |
| 3,748,791 | 7/1973 | Foster | 51/5 C |
| 3,823,596 | 7/1974 | Elder et al. | 113/116 V |
| 3,880,198 | 4/1975 | Vermeulen | 139/435 |

*Primary Examiner*—Leon Gilden
*Attorney, Agent, or Firm*—Donald D. Denton

[57] ABSTRACT

Method of forming profiled reed blades by stamping from a metal strip, in which method the reed blades are processed while the ends thereof are still a part of the metal strip, with a final stamping out of the ends to complete the formation of the reed blades.

10 Claims, 3 Drawing Figures

METHOD FOR THE MANUFACTURE OF PROFILED REED BLADES FOR LOOM REEDS

BACKGROUND OF THE INVENTION

The present invention relates to a method of producing profiled reed blades for reeds from a strip having a thickness of material corresponding to the thickness of the blade, in which the reed blades are stamped longitudinally parallel and spaced from each other, from the strip.

Profiled reed blades have heretofore been produced by stamping from the strip, followed by the further working of the stamped reed blades. This means that in the course of the manufacturing process, the individual reed blades must be handled several times by the operator, fed to a processing machine or device, collected, and sorted. Aside from the fact that this means a large amount of time and labor, this method of manufacture has constantly led to damage to the surface of the reed blades and/or to the bending thereof.

SUMMARY OF THE INVENTION

The present invention provides a method by which the reed blades can be produced in an economical and simplified manner and with the greatest possible protection of the work piece.

The method of the invention is characterized by the fact that, in a first process step, the regions of the strip between the longitudinal edges of the separate reed blades are punched out, that all further process steps for producing the reed blades are carried out on the blades while they are connected at their longitudinal ends to the remaining portion of the strip, and that in a final process step the longitudinal ends of the reed blades are separated from the remaining portion of the strip to form the complete profile of the reed blade.

In the method of the invention, the reed blades are thus firmly connected to the remaining portion of the strip until the final process step and they are obtained as individual pieces only at the very end of the manufacturing process. This leads on the one hand to the shape of the reed blades being only slightly affected during the manufacturing process while on the other hand it permits the greatest possible simplification of the manufacturing process.

A preferred embodiment of the process of the invention in which any deformations of the blades are reduced to a minimum is characterized by the fact that the stamped out regions of the strip between the longitudinal edges of the individual reed blades are produced in several, preferably three, steps, only the region of the strip which forms a part of the profiled region of the reed blades being pre-stamped in the first step.

The invention furthermore relates to the use on jet looms and particularly air-jet looms of the reed blades produced by the process set forth above.

BRIEF DESCRIPITION OF THE DRAWINGS

The invention will be illustrated and described in further detail with reference to preferred embodiments, in which illustrations:

DESCRIPTION OF THE PREFERRED EMBODIMENTS

Figure 1:
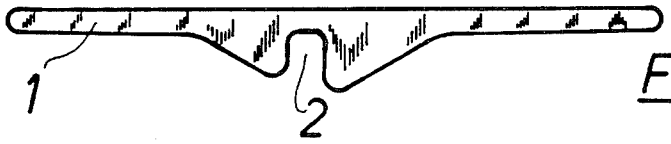
FIG. 1 is a top view of a reed blade formed by the process of this invention.

FIG. 1 illustrates a reed blade 1 for the reed of an air-jet loom. This reed blade has on that longitudinal edge which during operation faces the fell of the cloth the profile shown in the drawing. The longitudinal edge has a U-shaped recess 2 which forms part of a tunnel which extends over the entire width of the reed and is open towards the fell of the cloth. The other longitudinal edge of the reed blade 1 is straight. The reed blade 1 should have, close to its longitudinal ends, side surfaces which are as flat and undamaged as possible, with cleanly rounded edges. In the region of the longitudinal ends which are formed by the cutting operation, the requirements are not so high since the longitudinal ends are embedded in rails and thus do not come into contact with either the warp yarns or the filling yarns.

Figure 2:
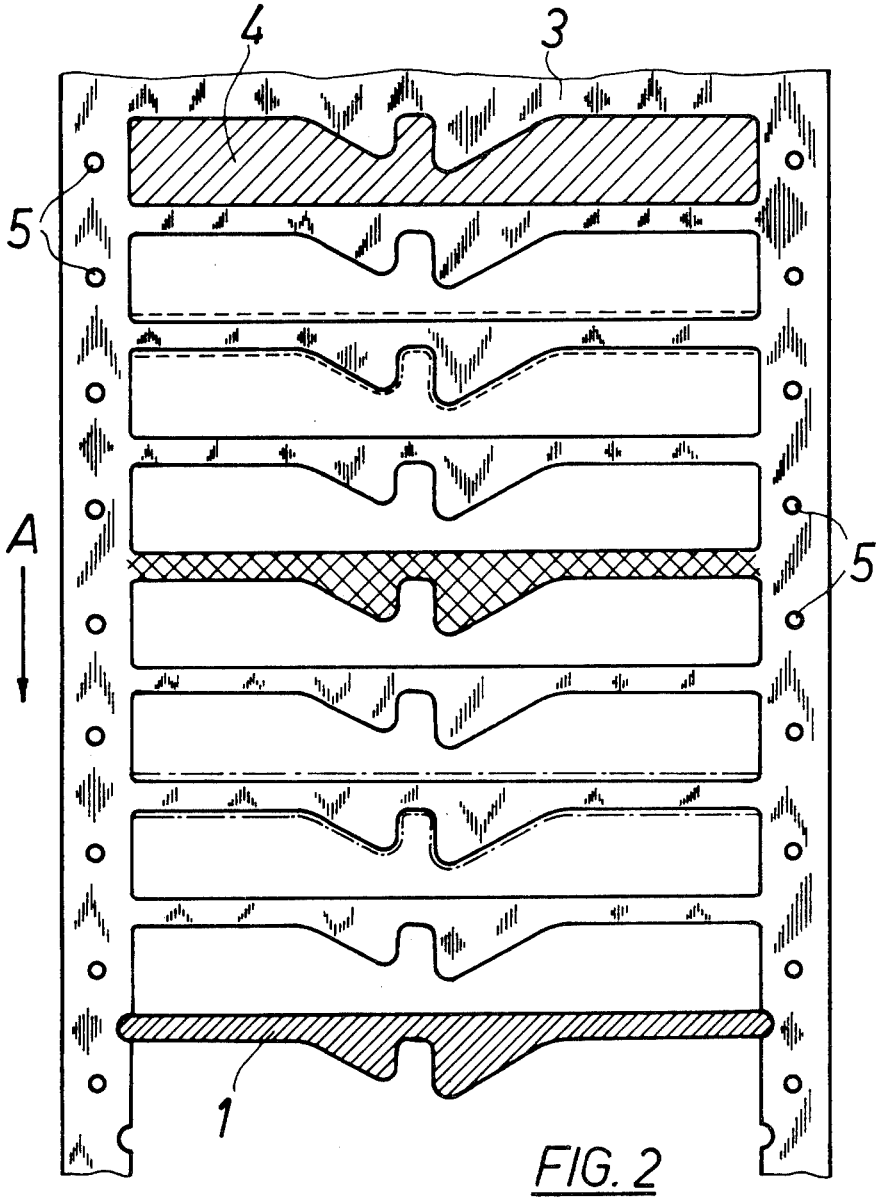
FIG. 2 is a top view of a strip serving as starting material for the reed blades during the manufacture of the reed blades.

In FIG. 2 there is shown a starting material for the manufacture of the reed blades 1 which is a strip 3 whose width is greater than the length of the reed blades 1, so that the reed blades 1 can be cut out of the strip, with their longitudinal directions lying in the tranvserse direction of the strip. The strip 3, which consists of the material desired for the reed blades 1, for instance sheet metal, has the surface quality desired for the reed blades 1. The thickness of the strip 3 corresponds to the thickness of the reed blades 1.

The process of manufacture of the reed blades 1 proceeds in the following manner: In a first process step, the region of the strip 4 between the individual reed blades 1 is prestamped. The reed blades 1 which are thus exposed except for their longitudinal ends therefore remain firmly connected at their longitudinal ends to the strip 3 after the first process step. Thereupon the reed blades 1, while still connected at their longitudinal ends to the strip 3, are subjected to the following process steps: embossing of the edges, trueing, and polishing of the edges, as well as, possibly of the surfaces.

After the polishing, the reed blades 1, which have now been completely machined, are stamped out of the strip 3 at their longitudinal ends, whereby the manufacturing process is practically concluded. The finished reed blades 1 are thereupon further checked, sorted, and packed, these operations being integrated within the total course of the work, so as to assure the greatest possible protection of the reed blades.

In the method of manufacture described, a strip 3 of given length can pass, in each case, successively through the different process steps or, as indicated in FIG. 2, the different process steps can be carried out simultaneously on a strip 3 which is unwound from a roll. The strip 3 shown in the figure, the direction of advance of which is indicated by arrow A, is provided on each of its edges adjacent to each strip region 4 which is to be stamped-out in the first process step, with a centering hole 5 for finder pins in order to assure precision of indexing. The manufacturing apparatus comprises a first stamping station, an embossing station, a trueing station, a polishing station, and a second stamping station, the four last-mentioned stations being each spaced apart from each other by twice the distance between two successive centering holes 5.

The first stamping station, in which the strip regions 4 are stamped out, is indicated by a hatching of the region 4 of the strip in the drawing, the embossing station by a dashed line extending outside the edges of the reed blade 1, the trueing station by a cross-hatching of the reed blade 1, the polishing station by a dot-dash line extending outside of the edges of the reed blade 1 and the second stamping station by a hatching of the reed blade 1.

Since the reed blades 1 have a semicircular rounding at their longitudinal ends (FIG. 1), the length of the strip region 4 which is to be stamped out is so dimensioned that it is smaller than the length of the reed blades 1 so that the rounding of the longitudinal ends is effected jointly with their removal from the strip 3.

Figure 3:
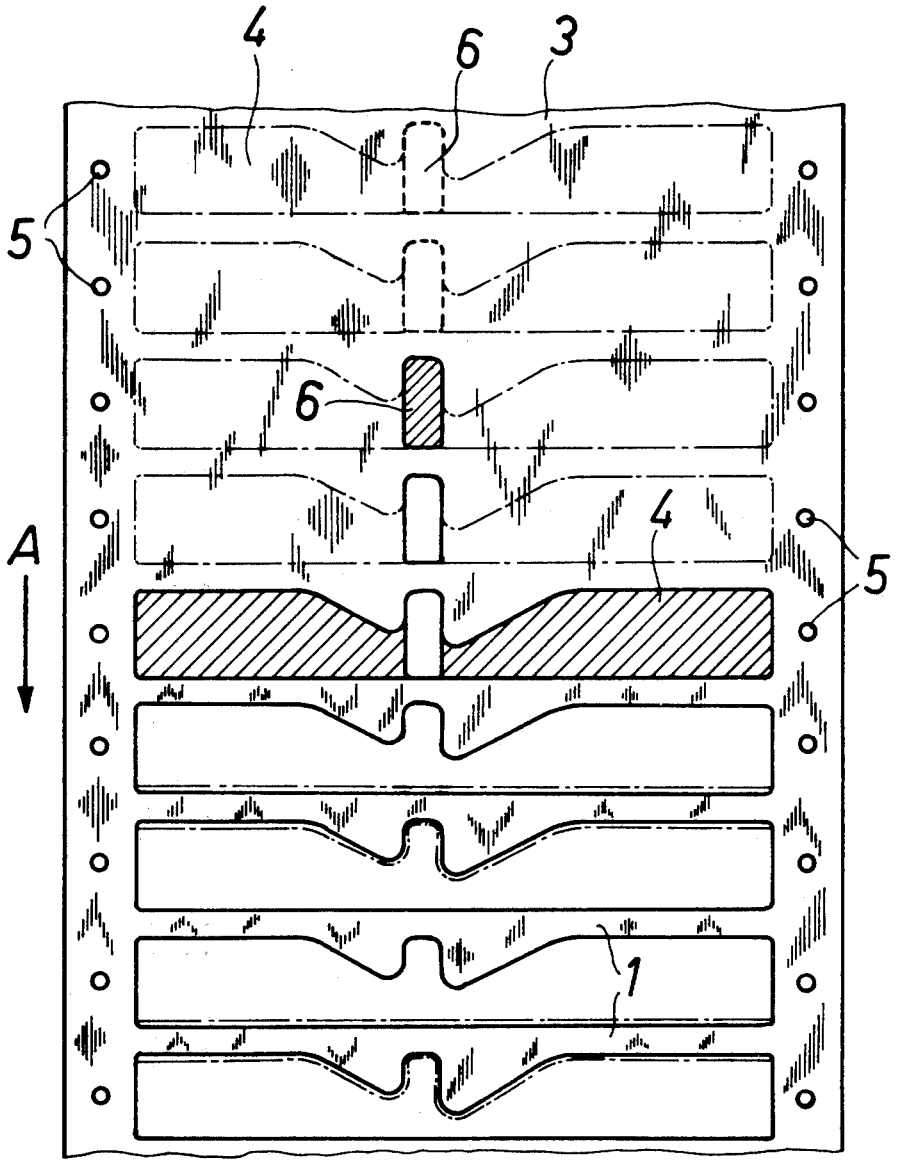
FIG. 3 shows a variant detail of FIG. 2.

In accordance with FIG. 3, the first process step, in which the strip region 4 is stamped out between the individual reed blades 1, is broken down into three individual steps: In a first individual step the part 6 of the strip region 4 which forms the U-shaped recess 2 is pre-stamped, i.e. indented or partially pressed through; in a second individual step the prestamped part 6 is punched out and in a third individual step the remaining part of the strip region 4 is finally punched out.

The embossing of the edges can also be carried out in several, for instance two, individual steps, namely first of all on the one side surface of the reed blades 1 and then on the other side surface thereof lying in FIG. 3 in the plane of the drawing. Accordingly, the manufacturing apparatus comprises first, second and third stamping stations, two embossing stations, a trueing station, a polishing station, and a fourth stamping station.

The first stamping station, in which the part 6 of the strip region 4 which forms the U-shaped recess 2 (FIG. 1) is pre-stamped, is indicated by the dashed line which represents the circumference of this part of the strip region 4; the second stamping station, in which the pre-stamped part 6 is punched out is indicated by an oblique hatching of said part; and the third stamping station in which the remaining part of the strip region 4 is punched out is indicated by an oblique hatching of this remaining part. The two embossing stations are indicated by a dot-dash line which extends outside the corresponding edges of the reed blades 1; the other stations are not further indicated.

By the dividing of the first process step, which represents the severest stressing of the reed blades, into three individual steps, a substantial reduction of any possible deformation of the reed blades is obtained. The embossing of the edges in two steps also contributes to such reduction.

It has been found that the reed blades produced by the process of this invention, when used in a loom, allow for a highly efficient loom performance. This is particularly so in jet looms such as air-jet looms, and the like.

It will be appreciated that various changes and/or modifications may be made within the skill of the art without departing from the spirit and scope of the invention illustrated, described, and claimed herein.

We claim:

1. A process for forming finished trued profiled reed blades for loom reeds from strip material having a thickness corresponding to the thickness of the finished blade in which the reed blades are stamped from the strip material longitudinally parallel and spaced from each other, characterized by the fact that the reed blades are firmly connected at their ends to the strip until a final process step, are finished in this condition to the final product ready for use and are obtained as individual reed blades only after completion of the final process step, whereby in a first processing step strip regions between the lengthwise edges of the individual reed blades are punched out followed by treatment processing steps of the edges formed by the stamping which includes an embossing step, a trueing step, and a polishing step, all process steps for the forming of the reed blades except the final step being carried out on the blades while connected at their longitudinal ends to the strip material, to maintain trueness and in the said final processing step, the longitudinal ends of each reed blade are separated from the strip to form the finished profiled trued reed blade.

2. The process according to claim 1 in which the punching out of the strip regions between the longitudinal edges of the individual reed blades is effected by a plurality of partial punching steps, only a region of the strip having a U-shaped recess forming a part of the profiled region of the reed blades being pre-stamped in a first step.

3. The process according to claim 2 in which the plurality of partial punching steps is three.

4. The process according to claim 2 in which in a second step, the pre-stamped region having a U-shaped recess is punched out.

5. The process according to claim 4 in which in a third step, the remaining part of the region of the strip between the longitudinal edges of the individual reed blades is stamped out.

6. The process according to claim 5 in which, after the first process step, the edges of the reed blades while attached to the sides of the strip are embossed in a second process step, the edges on the one side surface of the reed blades being embossed in a first step followed by the embossing of the edges on the other side surface in a second step.

7. The process according to claim 6 in which after the second process step the reed blades are trued in a third process step.

8. The process according to claim 7 in which after the third process step, the edges of the reed blades are polished in a fourth process step.

9. The process according to claim 8 in which the length of the strip regions to be punched out is selected smaller than the length of the reed blades and upon the last process step at the same time as the separation of the longitudinal ends the latter are imparted a rounded shape.

10. The process according to claim 9 in which the separating of the longitudinal ends and their rounding is effected by stamping.

* * * * *